US006155054A

United States Patent [19]

Liebig

[11] Patent Number: 6,155,054

[45] Date of Patent: Dec. 5, 2000

[54] STEAM POWER PLANT AND METHOD OF AND CLEANING ITS STEAM/WATER CYCLE

[75] Inventor: Erhard Liebig, Laufenburg-Binzgen, Germany

[73] Assignee: Asea Brown Boveri AG, Baden, Switzerland

[21] Appl. No.: 09/373,622

[22] Filed: Aug. 13, 1999

[30] Foreign Application Priority Data

Aug. 18, 1998 [EP] European Pat. Off. ..... 98 81 0793

[51] Int. Cl.[7] ..... F01K 1/00

[52] U.S. Cl. ..... 60/657; 60/670

[58] Field of Search ..... 60/695, 670, 659, 60/657

[56] References Cited

U.S. PATENT DOCUMENTS

| | | | |
|---|---|---|---|
| 3,021,824 | 2/1962 | Profos . | |
| 4,843,824 | 7/1989 | Mushines | 60/657 X |
| 4,901,532 | 2/1990 | Silvestri, Jr. et al. | 60/657 |
| 4,976,100 | 12/1990 | Lee | 60/657 X |
| 5,297,389 | 3/1994 | Athey et al. | 60/657 |

FOREIGN PATENT DOCUMENTS

| | | |
|---|---|---|
| 0359735A1 | 3/1990 | European Pat. Off. . |
| 0561220A1 | 9/1993 | European Pat. Off. . |
| 0777035A1 | 6/1997 | European Pat. Off. . |
| 19544225A1 | 6/1997 | Germany . |

*Primary Examiner*—Hoang Nguyen
*Attorney, Agent, or Firm*—Burns, Doane, Swecker & Mathis, L.L.P.

[57] ABSTRACT

The steam generator (1) includes at least an evaporator (8), a low-pressure drum (10), a separator (13) and a blowdown tank (22). A recirculation line (16) extends from the separator (13) to the low-pressure drum (10). A line (12) with a feed unit (11) extends from the low-pressure drum (10) to the evaporator (8). The feed unit (11) is designed for a capacity which is larger than the capacity of normal full-load operation of the steam generator (1). The separator (13) communicates via two differing line sections (18, 20) with the blowdown tank (22). One line section (18) is designed for a large mass flow at a small pressure difference between the separator (13) and the blowdown tank (22). The other line section (20) is designed for a small mass flow at a high pressure difference between separator (13) and blowdown tank (22). In order to clean the working medium during a warm start, part-load or full-load operation, the feed unit (11) is operated at the larger capacity state such that water forms in the separator (13) which then can be drawn off into the blowdown tank.

10 Claims, 1 Drawing Sheet

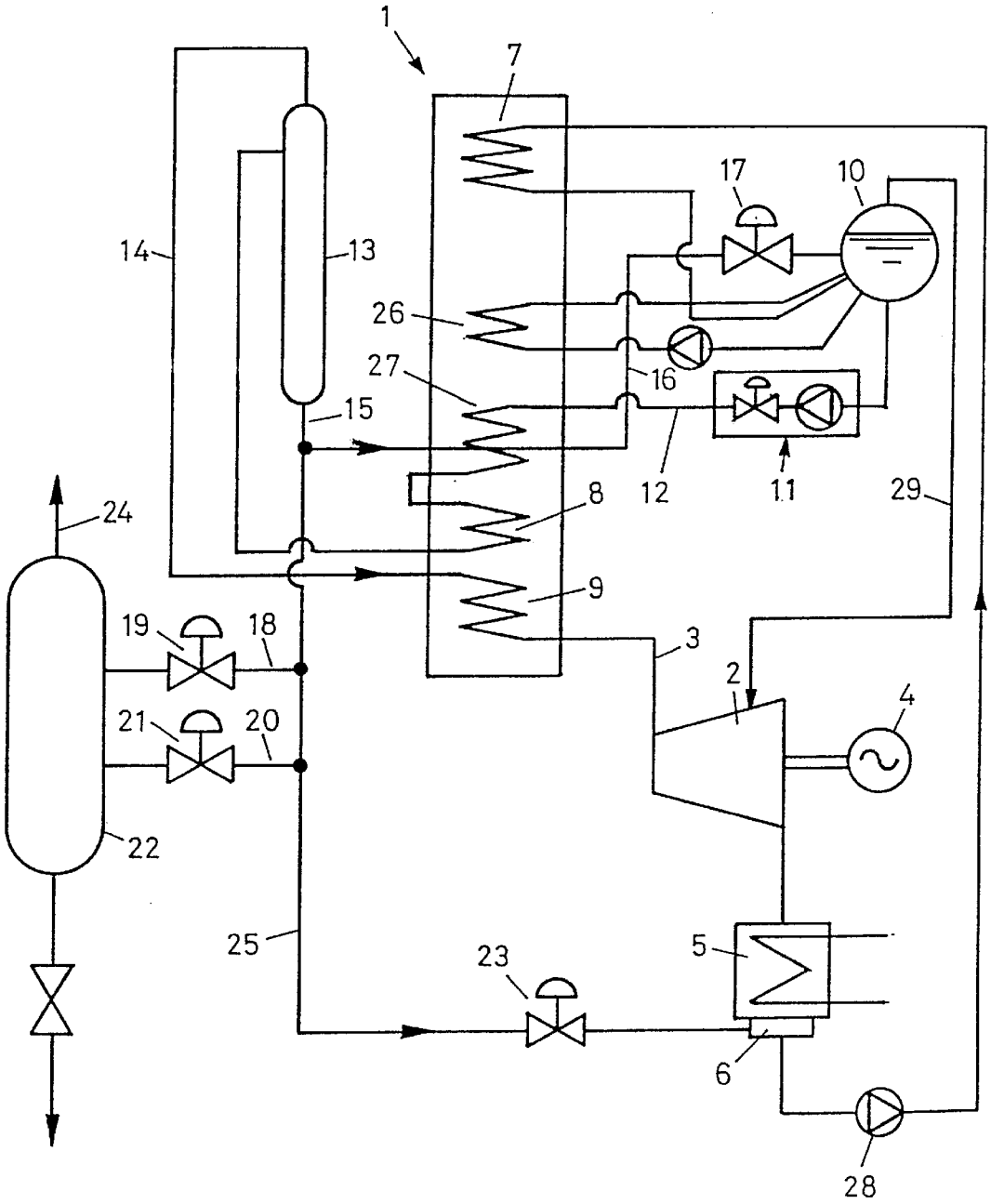
1
7
17
10
14
13
26
27
16
15
12
11
29
24
8
9
19
18
3
2
4
21
20
22
25
23
5
6
28

STEAM POWER PLANT AND METHOD OF AND CLEANING ITS STEAM/WATER CYCLE

BACKGROUND OF THE INVENTION

1. Field of the invention

The present invention relates to a steam generating and steam cycle plant having a forced circulation steam generator, which has at least one evaporator, a separator, a blowdown tank and a feed line, with a feed unit, extending to the evaporator, from which separator a steam outlet line leads away to a steam treatment station, which separator is connected to the evaporator by means of a supply line. It also relates to a method of operating such a plant during a cold start with adequate quality of the working medium of the steam/water cycle, a method of cleaning the steam/water cycle during a cold start with inadequate quality of the working medium of the steam/water cycle, a method of operation during a warm start with adequate quality of the working medium and a method of cleaning the steam/water cycle during a warm start, full-load operation or part-load operation with inadequate quality of the working medium.

2. Discussion of Background

Impurities in the steam/water cycle of steam generating and steam cycle plant, for example steam power stations, can lead to deposits and corrosion and, in consequence, to operational interference and damage. For this reason, the operating medium for such plant must be cleaned.

In plant with drum boilers, impurities are removed by blowing- down the boiler water. This is based on the following principle. Evaporation of the water takes place in the boiler drum. Non-volatile substances remain in the boiler water and are concentrated by this. Blowing down the boiler water then removes these substances in concentrated form and therefore efficiently from the cycle.

In plant with forced circulation boilers, no water can be blown down—the feed water enters the boiler and leaves it as steam. In consequence, all the non-volatile substances remain in the boiler. Thus, deposits of iron oxide in the evaporator part are not unusual either. In the case of forced circulation boilers, therefore, condensate cleaning plants are usually inserted in the cycle; the condensate is filtered and, if appropriate, also desalinated by means of ion exchangers in these plants before being returned to the steam generator.

On cold start and run-down of forced circulation boilers, during evaporation instabilities and during part-load operation, under which conditions wet steam reaches the separator, recirculation of the boiler water takes place by means of a pump. Recirculation therefore takes place during start-up and run-down, for which purpose the water level in the separator must reach a required value. With an increasing supply of heat to the boiler, the steam generation increases and the circulating quantity decreases correspondingly.

In forced circulation boilers, superheated steam reaches the separator from a specified heat output onwards, so that pure forced circulation operation can take place.

SUMMARY OF THE INVENTION

Accordingly, one object of the invention is to provide a novel steam generating plant which, when it is configured as a forced circulation boiler, does not require a condensate cleaning plant or a pump for recirculation, and by means of which start-up can be combined with cleaning.

In accordance with the invention, this is achieved by means of a steam generating plant in which the separator is in connection with a first water tank via a recirculation line section equipped with a first control valve, is in connection with a second water tank via a further line section equipped with a second control valve, is in connection with the blowdown tank via a third line section equipped with a third control valve, is likewise in connection with the blowdown tank via a fourth line section equipped with a fourth control valve, the pressure in the first water tank being higher than the pressure in the second water tank during operation of the steam generating plant.

The water tank with a first pressure can, for example, be a low-pressure steam drum, a feed water tank or a preheater of the plant. The water tank with the lower, i.e. second pressure, can for example be the hot well of a condenser of a steam turbine group fed by the steam boiler plant, a feed water tank or an untreated water tank.

The method of operating this plant during a cold start with adequate quality of the working medium of the steam/water cycle is distinguished by the fact that the second control valve of the further line section is open and the first, third and fourth control valve are closed, so that the proportion of water in the separator is led away through the further line section into the second water tank.

In addition, the method of operating this plant in order to clean the working medium of the steam/water cycle during a cold start with inadequate quality of the working medium of the steam/water cycle is distinguished by the fact that the third control valve in the third line section, which is configured as a blowdown line for a large mass flow at small pressure difference, is open and the first, second and fourth control valves are closed, so that the proportion of water of inadequate quality in the separator is led away through the third line section into the blowdown tank.

The method of operating the plant during a warm start with adequate quality of the working medium of the steam/water cycle, the pressure in the separator being higher than the pressure in the first water tank, is distinguished by the fact that the first control valve in the recirculation line section is open and the second, third and fourth control valves are closed, so that the proportion of water in the separator flows through the recirculation line section into the first water tank because of the pressure difference between the separator and the first water tank.

The method of operating the plant in order to clean the steam/water cycle during a warm start, full-load operation or part-load operation with inadequate quality of the working medium of the water/steam cycle is distinguished by the fact that the evaporator is acted upon in such a way that wet steam reaches the separator and that the fourth control valve in the fourth line section, which is configured as a blowdown line for a small mass flow at large pressure difference, is open and the first, second and third control valves are closed, so that the proportion of water of inadequate quality in the separator is led away through the fourth line section into the blowdown tank.

The advantages of the invention may essentially be seen in the fact that no condensate cleaning plant is necessary in the water/steam cycle. The run-up and part-load operation do not take place by means of the known, classical circulation operation and, in particular, no pump is necessary for this purpose and no major switching operations have to be undertaken. In addition, the cleaning can be combined with the run-up, in particular the cold run-up of the plant.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein an embodiment example of the invention is represented, purely diagrammatically, with reference to a thermal power station. Only the elements essential for understanding the invention are shown.

DESCRIPTION OF THE PREFERRED EMBODIMENTS

Referring now to the drawings, wherein like reference numerals designate identical or corresponding parts throughout the several views, the steam for the steam turbine 2 is generated in the steam generator 1 of the thermal power station, which steam generator (1) can be equipped with burners or the exhaust gases of at least one gas turbine can flow through it, i.e. the steam generator is configured as a waste-heat steam generator. The steam for the steam turbine 2 is supplied from the steam generator 1 through the live steam line 3 to the steam turbine 2. The steam turbine 2 drives a generator 4. The exhaust steam from the steam turbine 2 is supplied to the condenser 5 with a hot well 6. The feed water pump is designated by the reference numeral 28.

A low-pressure economizer 7, a low-pressure evaporator 26, a high-pressure economizer 27, a high-pressure evaporator 8 and a superheater 9 are represented in simplified manner in the steam generator 1, the live steam line 3 to the steam turbine 2 following on from the superheater 9. The low-pressure drum is designated by the reference numeral 10. A low-pressure steam line 29 extends from the low-pressure drum 10 to the steam turbine 2. A feed unit 11, consisting of feed pump and associated control valve, delivers the water from the low-pressure drum 10 through the line 12, the high-pressure economizer 27 and the high-pressure evaporator 8 to a precipitation bottle 13, also called a separator. In the embodiment shown, a steam line 14 extends from the separator 13 to the superheater 9, from which the live steam line 3 leads to the steam turbine 2. In other embodiments (not shown), the steam line 14 does not lead to a super-heater 9 and a steam turbine 2 as steam processing stations but, for example, to a steam network, not connected to a power generation system, as the steam processing station.

As shown in the figure in the drawing, an outlet flow line 15 is connected to the bottom of the separator 13, various line sections 16, 18 and 20 branching off from this outlet flow line 15 and the latter being continued in a line section 25. It is obvious that each line section 16, 18, 20, 25 can be connected individually and per se separately to the separator 13. The decisive feature is simply that the separator 13 is in connection with further plant parts via different line sections.

A recirculation line section 16, in which a first control valve 17 is arranged and which extends back to the low-pressure drum 10, branches off from the outlet flow line 15.

The outlet flow line 15 continues via a further line section 25 to the hot well of the condenser 5. A second control valve 23 is arranged in this further line section 25.

During the operation of the plant, therefore, the low-pressure drum 10 is a water tank with a first pressure which is lower than the pressure in the separator 13, and the hot well 6 is a water tank with a second pressure which is lower than the first pressure.

In further embodiments, it is also possible for a low-pressure drum, a feed water tank or a pre-heater to act as the water tank with a first pressure.

The condenser, in which there is even a vacuum, a further feed water tank or an untreated water tank can act as the water tank with a second, lower pressure.

A third line section 18, as a blowdown line with a third control valve 19, and a fourth line section 20, as a second blowdown line with a fourth control valve 21, branch off from the outlet flow line 15 to an expansion tank 22, which is also referred to as a blowdown tank.

The blowdown line first mentioned, i.e. the third line section 18, is configured for a larger mass flow at a first, small pressure difference between the separator 13 and the blowdown tank 22, and the blowdown line mentioned second, i.e. the fourth line section 20, is configured for a smaller mass flow at a second pressure difference which is larger than the first pressure difference.

The plant shown can be operated as follows.

It is assumed that the water quality is inadequate and the power station is put into operation from a cold start.

During a first time interval, the pressure difference between the separator 13 and the low-pressure drum 10 is fundamentally inadequate for recirculation through the recirculation line 16. The feed unit 11 is now operated in such a way that the flow through the high-pressure evaporator 8 is approximately 30% of the nominal water flow (as compared with full-load operation).

The third control valve 19 in the third line section 18 is in the open position and the first control valve 17 in the recirculation line section 16 before the low-pressure drum 10, the second control valve 23 in the further line section 25 before the hot well 6 and the fourth control valve 21 in the fourth line section 20 before the blowdown tank 22 are closed.

The third line section 18 is designed for a large mass flow at small pressure difference between separator 13 and blowdown tank 22 and, in consequence, water can be withdrawn until an adequate water quality is present. The water flowing out at the bottom of the blowdown tank 22 is led away in known manner to a treatment plant. The steam forming at temperatures above 100° C. flows out of the blowdown tank through the outlet 24.

If, during a cold start, the water quality is adequate, the pressure difference being again too small for recirculation from the separator 13 to the low-pressure drum 10, both control valves 19, 21 before the blowdown tank 22 and the control valve 17 before the low-pressure drum 10 are closed, and the control valve 23 in the line section 25 leading to the hot well 6 is open. In consequence, the water from the separator 13 is led away into the hot well 6 of the condenser 5 and therefore remains in the steam/water cycle.

In the case of a warm start with an adequate water quality, the pressure in the separator 13 being higher than the pressure in the low-pressure drum 10, the first control valve 17 in the recirculation section 16 is open and the second control valve 23 in the further line section 25 leading to the hot well 6, the third control valve-19 and the fourth control valve 21 before the blowdown tank 22 are closed. The water located in the separator 13 or reaching the separator 13 can therefore be recirculated into the low-pressure drum 10 by the pressure difference alone and therefore remains in the steam/water cycle.

If the water quality is inadequate (during a warm start but also in the case of full-load or part-load operation), the feed unit 11 is operated at a throughput which is increased in comparison with the normal operation, so that wet steam with a proportion of water in the steam of between 5% and 20% is present at the outlet from the high-pressure evaporator 8. The pressure difference between the separator 13 and the blowdown tank 22 is high, for example between 60 and 180 bar.

The fourth control valve 21 of the fourth line section 20 before the blowdown tank 22 is now opened. The third control valve 19 of the third line section 18, the second control valve 23 before the hot well 6 and the first control valve 17 before the low-pressure drum 10 remain closed.

Because of the proportion of water of between 5% and 20% in the steam coming from the evaporator 8, water which contains the impurities forms in the separator 13 and this water is led through the fourth line section 20 into the blowdown tank 22. This fourth line section 20 is designed for a small mass flow at large pressure difference.

It may therefore be seen that there is no longer a necessity for a condensate cleaning plant, that no pump is necessary between the separator 13 and the low-pressure drum and, in particular, that cleaning can be combined with run-up by means of this plant.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by: Letters Patent of the United States is:

1. A steam generating plant having a forced circulation steam generator (1), which has at least one evaporator (8), a separator (13), a blowdown tank (22) and a feed line (12), with a feed unit (11), extending to the evaporator (8), from which separator (13) a steam outlet line (14) leads away to a steam treatment station, which separator (13) is connected, via a supply line to the evaporator (8), wherein the separator (13)

is in connection with a first water tank (10) via a recirculation line section (16) equipped with a first control valve (17), is in connection with a second water tank (6) via a further line section (25) equipped with a second control valve (23), is in connection with the blowdown tank (22) via a third line section (18) equipped with a third control valve (19), is likewise in connection with the blowdown tank (22) via a fourth line section (20) equipped with a fourth control valve (21), the pressure in the first water tank (10) being higher than the pressure in the second water tank (6) during operation of the steam generating plant.

2. The plant as claimed in claim 1, wherein the third line section (18) and fourth line section (20) are configured as blowdown line sections, the third line section (18) being configured for a larger mass flow and a smaller pressure difference between the separator (13) and the blowdown tank (22), as compared with the fourth line section (20).

3. A method of operating the plant as claimed in claim 1 or 2 during a cold start with adequate quality of the working medium of the steam/water cycle, wherein the second control valve (23) of the further line section (25) is open and the first control valve (17), the third control valve (19) and the fourth control valve (21) are closed, so that the proportion of water in the separator (13) is led away through the further line section (25) into the second water tank (6).

4. A method of operating the plant as claimed in claim 1 or 2 in order to clean (the working medium) of the steam/water cycle during a cold start with inadequate quality of the working medium of the steam/water cycle, wherein the third control valve (19) in the third line section (18), which is configured as a blowdown line for a large mass flow at small pressure difference, is open and the first control valve (17), the second control valve (23) and the fourth control valve (21) are closed, so that the proportion of water of inadequate quality in the separator (13) is led away through the third line section (18) into the blow-down tank (22).

5. A method of operating the plant as claimed in claim 1 or 2 during a warm start with adequate quality of the working medium of the steam/water cycle, the pressure in the separator (13) being higher than the pressure in the first water tank (10), wherein the first control valve (17) in the recirculation section (16) is open and the second control valve (23), the third control valve (19) and the fourth control valve (21) are closed, so that the proportion of water in the separator (13) flows through the recirculation line section (16) into the first water tank (10) because of the pressure difference between the separator (13) and the first water tank (10).

6. A method of operating the plant as claimed in claim 1 or 2 in order to clean the steam/water cycle during a warm start, full-load operation or part-load operation with inadequate quality of the working medium of the water/steam cycle, wherein the evaporator (8) is acted upon in such a way that wet steam reaches the separator (13) and wherein the fourth control valve (21) in the fourth line section (20), which is configured as a blowdown line for a small mass flow at large pressure difference, is open and the first control valve (17), the second control valve (23) and the third control valve (19) are closed, so that the proportion of water of inadequate quality in the separator (13) is led away through the fourth line section (20) into the blowdown tank (22).

7. The method as claimed in claim 6, wherein the presence of wet steam at the inlet to the separator (13) is effected by the feed unit (11) being operated in such a way that it supplies a higher mass flow than that in normal operation for the same steam generation delivery.

8. The method as claimed in claim 6, wherein the presence of wet steam at the inlet to the separator (13) is effected by the supply of heat in the forced circulation steam generator being reduced while retaining the feed by the operation of the feed unit (11).

9. The method as claimed in claim 4, wherein the evaporator (8) and the feed unit (11) are operated with about 20–50% of the nominal water quantity during full-load operation.

10. The method as claimed in claim 6, wherein the evaporator (8) and the feed unit (11) are operated in such a way that the proportion of water at the outlet from the evaporator (8) and/or at the inlet to the separator (13) lies in the range between 5% and 20%, the pressure difference between the separator (13) and the blowdown tank (22) lying in the range of 60–180 bar.

* * * * *